US006536137B1

(12) United States Patent
Celia

(10) Patent No.: US 6,536,137 B1
(45) Date of Patent: Mar. 25, 2003

(54) FOOTWEAR SUPPORT SYSTEM

(75) Inventor: Wayne M. Celia, Paramus, NJ (US)

(73) Assignee: H.H. Brown Shoe Technologies, Inc.

( * ) Notice: Subject to any disclaimer, the term of this patent is extended or adjusted under 35 U.S.C. 154(b) by 0 days.

(21) Appl. No.: 09/584,221

(22) Filed: May 31, 2000

(51) Int. Cl.[7] ..... A43B 13/18

(52) U.S. Cl. ..... 36/28; 36/30 R; 36/44; 36/37

(58) Field of Search ..... 36/28, 30 R, 43, 36/44, 37, 71

(56) References Cited

U.S. PATENT DOCUMENTS 4,176,476 A * 12/1979 Hassell
4,557,060 A * 12/1985 Kawashima
4,624,061 A * 11/1986 Wezel et al.
4,694,590 A * 9/1987 Greenwalt
5,005,575 A * 4/1991 Geri
5,086,574 A * 2/1992 Bacchiocchi
5,146,698 A * 9/1992 Tilles et al.
5,313,717 A * 5/1994 Allen et al.
5,433,987 A * 7/1995 Peterson et al.
5,465,508 A * 11/1995 Bourdeau
5,611,153 A * 3/1997 Fisher et al.
5,669,162 A * 9/1997 Dyer
5,733,647 A * 3/1998 Moore, III et al.
5,746,013 A * 5/1998 Fay, Sr.
5,753,357 A * 5/1998 Filipitsch et al.
5,787,609 A * 8/1998 Wu

* cited by examiner

*Primary Examiner*—Ted Kavanaugh
(74) *Attorney, Agent, or Firm*—St. Onge Steward Johnston & Reens LLC

(57) ABSTRACT

A footwear support system of the type positioned within an inner volume of an article of footwear includes a footbed and an insole insert. The footbed includes a body having an upper surface and a cavity formed within the upper surface for receiving an insole insert. The cavity has a shape corresponding to the shape of the insole insert and a depth corresponding to the thickness of the insole insert. The insole insert may include interchangeable insole inserts, one including hydrophilic urethane for insulating a wearer's foot in cold environments and another including thermally insulative material for cooling a wearer's foot in warm environments. The footwear support system based on the footbed provides greater comfort to a wearer's foot.

9 Claims, 3 Drawing Sheets

FOOTWEAR SUPPORT SYSTEM

BACKGROUND

The invention relates to a footwear support system of the type positioned within the inner volume of an article of footwear. Footwear support systems often are configured to include a footbed and an insole insert attached to the footbed. Certain footwear support systems absorb shock during walking, running or other forms of exercise, thereby minimizing the possibility of injury to the wearer's foot and joint. Such footwear support systems also increase the support for the wearer's foot and provide greater comfort. Since the footwear support system is in direct contact with the wearer's foot, it is important that it anatomically conforms to the wearer's foot.

SUMMARY

The invention features a footwear support system of the type positioned within an inner volume of an article of footwear (e.g., shoe or boot) and having an insole insert attached to a footbed.

In a general aspect of the invention, the footbed of the footwear support system includes a body having an upper surface and a cavity formed within the upper surface for receiving an insole insert. The cavity is defined by a peripheral region of the body which extends upwardly from the upper surface of the body. The cavity has a shape corresponding to the shape of the insole insert and a depth corresponding to the thickness of the insole insert.

In another aspect of the invention, a footwear support system includes the footbed described above and a corresponding insole insert.

In still another aspect of the invention, a footwear support system includes the footbed described above and a pair of interchangeable insole inserts, each having a thickness corresponding to the predetermined depth of the cavity. The second interchangeable insole insert has properties different from that of the first interchangeable insole insert.

Because the cavity has a shape and depth corresponding to the shape and thickness of the insole insert, the footwear support system has a uniform surface, which anatomically conforms to the wearer's foot. Edges or corners formed by differences between the thickness of the insole insert and the depth of the cavity are virtually eliminated. As a result, the footbed provides greater comfort to a wearer's foot.

Embodiments of these aspects of the invention may include one or more of the following features.

The depth of the cavity may be in a range between 0.06 inches and 0.25 inches. The thickness of the insole insert may be slightly higher than the predetermined depth of the cavity to allow for compression from a wearer's foot. The body of the footbed may include a polymer selected from a group consisting of polyurethane, EVA, polyethelene and TPU's. The footbed further may include an outer support region surrounding the peripheral region. The outer support region may has a bottom surface adapted to conform to the inner volume of the article of footwear, and a top surface adapted to support a peripheral portion of a sole of a wearer's foot.

In one embodiment, the insole insert may include hydrophilic urethane. The insole insert may further include additives such as absorptive fillers, fibrous materials, surfactants, odor absorbents, bactericides, pH buffers, rubber particles and thermal phase change particles. In another embodiment, the footbed may be made from a urethane system and the insole insert may be made from a hydrophilic urethane formulation. The insole insert may be permanently attached to the cavity of the footbed.

In the embodiments of the aspect including a pair of interchangeable insole inserts, the interchangeable insole insert may be attached non-permanently to the cavity of the footbed using a velcro fastening system. For example, in one embodiment of this aspect, the first insole insert includes hydrophilic urethane for insulating a wearer's foot in cold environments. The second insole insert, on the other hand, has properties for cooling a wearer's foot in warm environments. For example, the second insole insert can be formed from urethane foam or other lightweight and relatively high clo material such as Thinsulate® or Lite Loft®, products of Minnesota Mining and Manufacturing Company, St. Paul, Minn. These insulative inserts generally include a fabric laminate cover. Further details relating to other materials for forming insole inserts can be found in U.S. Pat. No. 5,763,335, entitled "Composite Material for Absorbing and Dissipating Body Fluids and Moisture", which is incorporated herein by reference.

Interchangeability of insole inserts is particularly advantageous where the article of footwear is used in different environments or under different wearing conditions.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
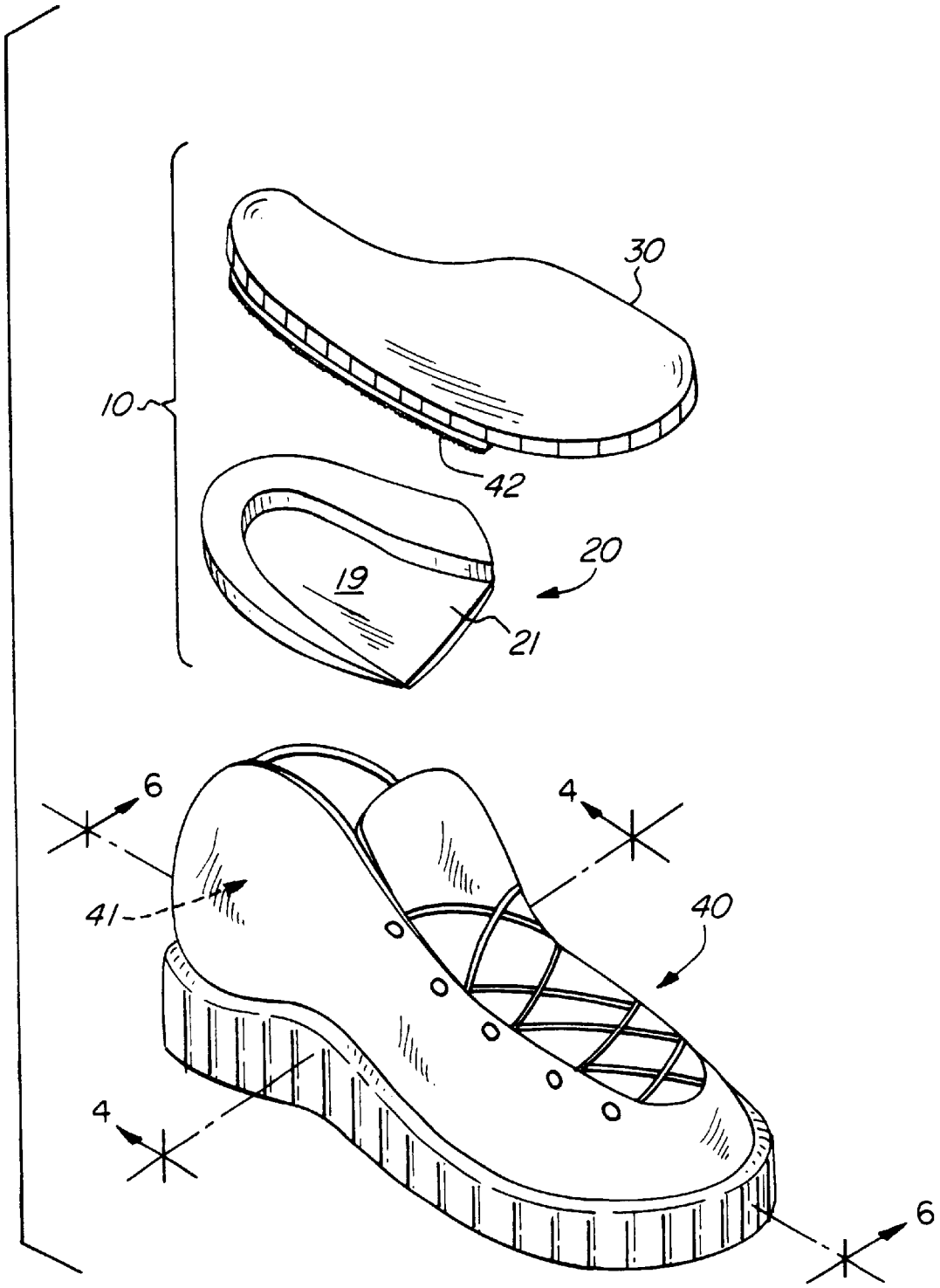
FIG. 1 is an exploded view of a footwear support system for use within a shoe.
Figure 2:
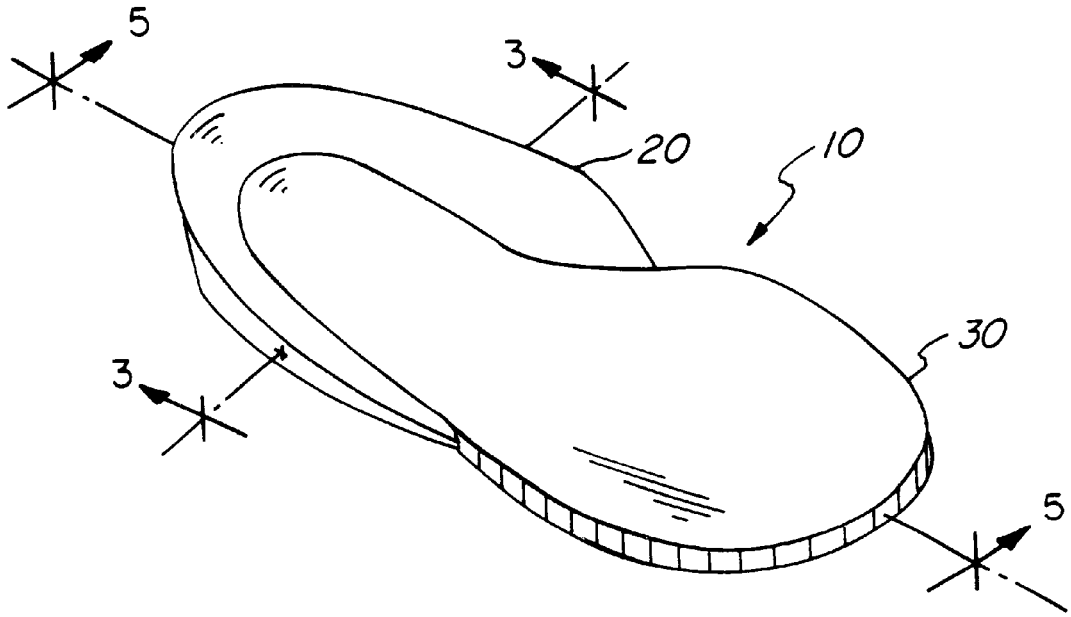
FIG. 2 is a perspective view of the footwear support system of FIG. 1.

Referring to FIG. 1, a footwear support system 10 includes a footbed 20 and an insole insert 30. The footwear support system 10, when positioned at the bottom of the inner volume 41 of a shoe 40, increases the support for the wearer's foot and provides a high degree of comfort. It absorbs shocks resulting from walking, running or other forms of exercise and prevents damage to the wearer's foot and joint. FIG. 2 is a perspective view of the footwear support system 10 showing the insole insert 30 attaches to the footbed 20.

Figure 3:
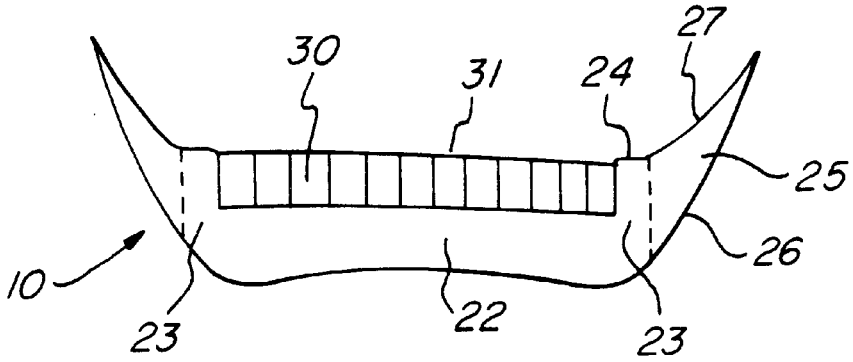
FIG. 3 is a cross-sectional end view of the footwear support system taken along lines 3—3 of FIG. 2.
Figure 5:
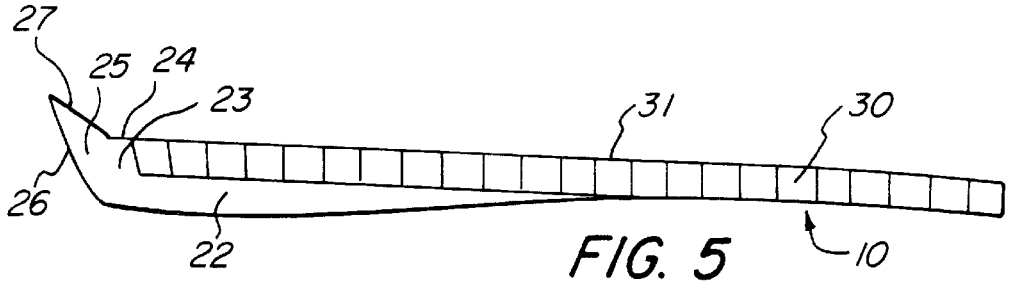
FIG. 5 is a cross-sectional side view of the footwear support system taken along lines 5—5 of FIG. 2.

Referring to FIG. 3 and FIG. 5, the footbed 20 includes a body 22 having an upper surface 19 and a peripheral region 23 of the body which extends upwardly from the upper surface of the body to define a cavity 21 (FIG. 1) for receiving an insole insert 30. The peripheral region 23 has a flat top surface 24 which aligns with a top surface 31 of the insole insert 30. The insole insert 30 is made from hydrophilic urethane which may or may not contain additives such as absorptive fillers, fibrous materials, surfactants, odor absorbents, bactericides, pH buffers, rubber particles and thermal phase change particles.

The cavity 21 has a shape corresponding to the shape of the insole insert 30 and a depth corresponding to the thickness of the insole insert 30. Preferably the thickness of the insole insert 30 is slightly higher than the depth of the cavity 21 so that when the wearer places weight on the support system, the insole insert 30 compresses to a thickness substantially that of the depth of the cavity 21. In this embodiment, the cavity 21 is formed within the upper surface 19 of the body 22 and has a depth in a range between 0.06 inches and 0.25 inches on the top surface of the body 22.

Figure 4:
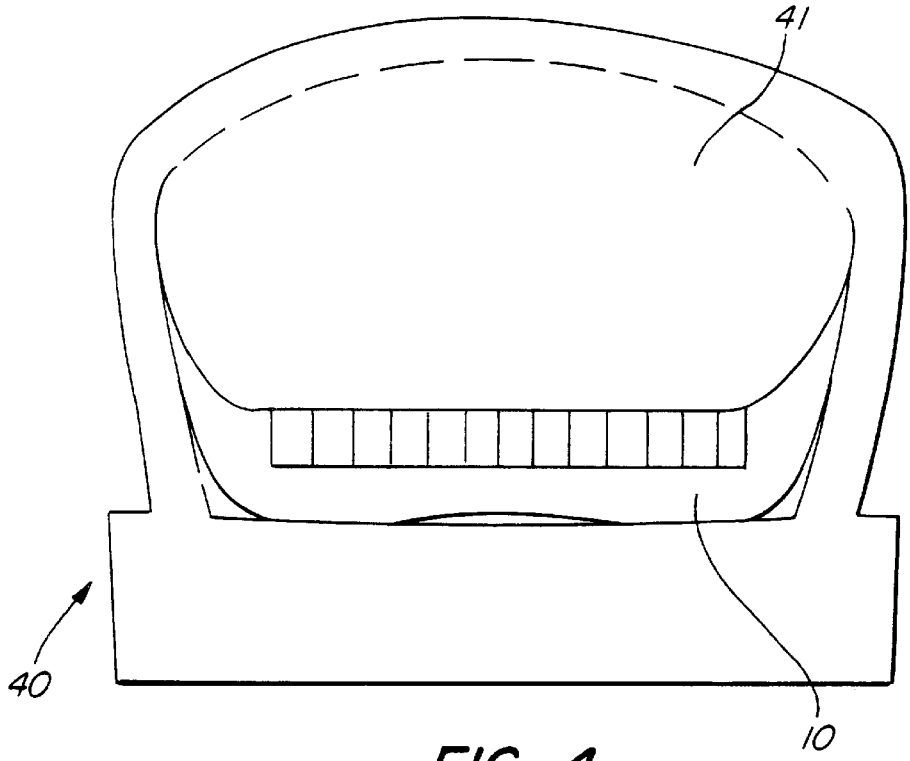
FIG. 4 is a cross-sectional end view of the shoe and the footwear support system taken along lines 4—4 of FIG. 1.
Figure 6:
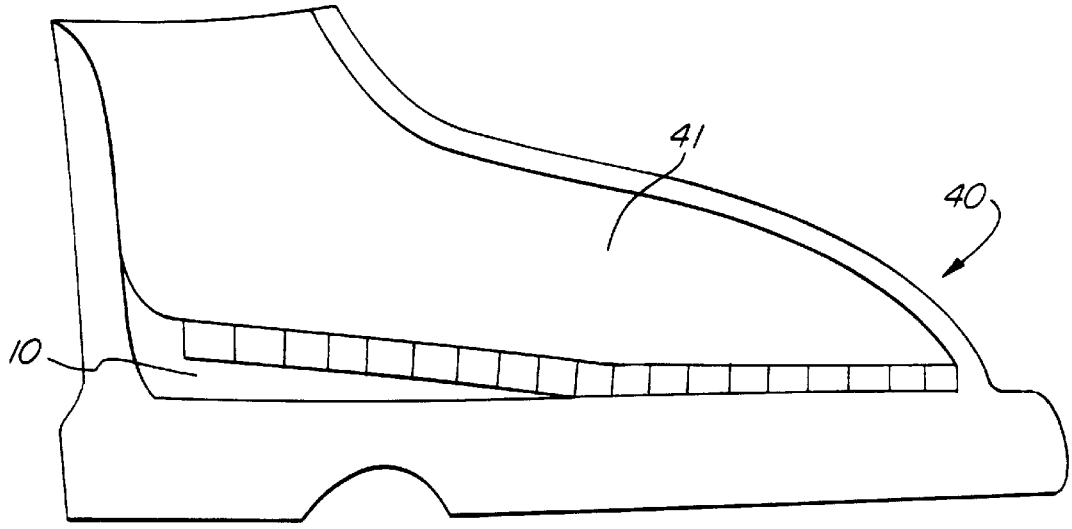
FIG. 6 is a cross-sectional side view of the footwear and the footwear support system taken along lines 6—6 of FIG. 1.

The footbed 20 further includes an outer support region 25 surrounding the peripheral region 23. The outer support region 25 has a bottom surface 26 adapted to conform to the inner volume 41 of the article of footwear 40 (FIG. 4 and FIG. 6), and a top surface 27 adapted to support a peripheral portion of the sole of the wearer's foot.

In this embodiment of this invention, footbed 20 is a molded ¾ length footbed made from polyurethane, EVA, polyethelene, TPU's or any similar materials common to the art.

Insole insert 30 is permanently attached to the footbed 20 using an adhesive (e.g., epoxy) suitable for bonding the materials of the insert and footbed in use. For example, if footbed 20 is made from a urethane system and insole insert 30 is made from a hydrophilic urethane formulation, a urethane based hot melt can be used to bond them together.

In alternative embodiments, insole insert 30 can be non-permanently attached to the footbed 20. For example, a VELCRO fastening system 42 can be used to allow the insole insert 30 to be interchanged with different insole inserts that have individual and distinct chemical or physical properties.

Interchangeability of insole inserts is particularly advantageous where the shoe 40 is used in different environments or under different wearing conditions. For example, in one embodiment, a footwear support system has a first interchangeable insole insert for use in winter and a second interchangeable insole insert for use in summer. The winter insert would be made from a hydrophilic urethane formulation that has properties which would insulate the foot in cold environments, while the summer insert would have properties that would cool the foot in warmer climates. Hydrophilic urethane absorbs moisture from foot perspiration which crystallizes within the insole. These moisture crystals dissipate after the shoe is taken off the foot.

In a different embodiment, the footwear support system has a first interchangeable insole insert for running or high activity which would incorporate a hydrophilic urethane formulation of higher density, suitable for greater shock absorption and cushioning, and a second interchangeable insole insert comprising a formulation of a lighter density intended for casual less active wear.

A number of embodiments of the invention have been described. Nevertheless, it will be understood that various modifications may be made without departing from the spirit and scope of the invention. For example, a molded ¾ length footbed is used in the above embodiment, footbed with other length (e.g., ⅔) may alternatively be used. Accordingly, other embodiments are within the scope of the following claims.

What is claimed is:

1. A footwear support system positioned within an inner volume of an article of footwear, the footwear support system comprising:

a footbed including a body having an upper surface and a cavity formed within the upper surface for receiving an insole insert, the cavity being defined by a peripheral region of the body which extends upwardly from the upper surface of the body, the cavity having a predetermined depth;

a first interchangeable insole insert comprising hydrophilic urethane for insulating a wearer's foot in cold environments and having a thickness corresponding to the pre-determined depth of the cavity; and a second interchangeable insole insert comprising thermally insulative material for cooling a wearer's foot in warm environments and having a thickness corresponding to the predetermined depth of the cavity, the second interchangeable insole insert being of a different material than the first interchangeable insole insert.

2. The footwear support system of claim 1 wherein the first insole insert has a shape which is the same with that of the second insole insert and the cavity has a shape corresponding to the shape of the insole inserts.

3. The footwear support system of claim 1 wherein the predetermined depth of the cavity is in a range between 0.06 inches and 0.25 inches.

4. The footwear support system of claim 1 wherein the insole inserts comprises additives selected from a group consisting of absorptive fillers, fibrous materials, surfactants, odor absorbents, bactericides, pH buffers, rubber particles and thermal phase change particles.

5. The footwear support system of claim 1 wherein the thickness of the insole inserts is in a range between 0.06 inches and 0.25 inches.

6. The footwear support system of claim 1 wherein the first insole insert is attached to the cavity of the footbed non-permanently.

7. The footwear support system of claim 1 wherein the second insole insert is attached to the cavity of the footbed non-permanently.

8. The footwear support system of claim 1 wherein the second insole insert is attached to the cavity of the footbed using a hook and nylon strip fastening system.

9. The footwear support system of claim 1 wherein the footbed further comprises an outer support region surrounding the peripheral region, the outer support region having a bottom surface adapted to conform to the inner volume of the article of footwear, and a top surface adapted to support a peripheral portion of a wearer's sole.

* * * * *